US007109954B2

(12) United States Patent
Wong et al.

(10) Patent No.: US 7,109,954 B2
(45) Date of Patent: Sep. 19, 2006

(54) INTEGRATED CIRCUIT DRIVER CHIP FOR AN ELECTROLUMINESCENT DEVICE

(75) Inventors: Chi Wai Wong, Room 1610, Tsui Tung House, Tsui Ping Estate, Kwun Tong, Kowloon (HK); Chi Kwong Li, Kowloon (CN)

(73) Assignee: Chi Wai Wong, Kowloon (HK)

( * ) Notice: Subject to any disclaimer, the term of this patent is extended or adjusted under 35 U.S.C. 154(b) by 258 days.

(21) Appl. No.: 10/653,870

(22) Filed: Sep. 3, 2003

(65) Prior Publication Data

US 2004/0113868 A1 Jun. 17, 2004

(30) Foreign Application Priority Data

Dec. 16, 2002 (CN) ..... 02 1 57176

(51) Int. Cl.
*G09G 3/30* (2006.01)

(52) U.S. Cl. ..... 345/76; 345/212

(58) Field of Classification Search ..... 345/36, 345/76, 77, 211, 212; 315/169.3, 219
See application file for complete search history.

(56) References Cited

U.S. PATENT DOCUMENTS 4,864,182 A * 9/1989 Fujioka et al. ..... 315/169.3
4,914,353 A * 4/1990 Harada et al. ..... 315/169.3
5,345,146 A * 9/1994 Koenck et al. ..... 315/169.3
6,466,192 B1 * 10/2002 Imamura ..... 345/98
6,518,962 B1 * 2/2003 Kimura et al. ..... 345/211
6,867,755 B1 * 3/2005 Ashizawa et al. ..... 345/76

* cited by examiner

*Primary Examiner*—Ricardo Osorio
(74) *Attorney, Agent, or Firm*—Alix, Yale & Ristas, LLP

(57) ABSTRACT

The present invention discloses an integrated circuit (IC) driver chip for electroluminescent (EL) device, including an EL display-data-control block (DCB) and an EL display-segment-driver block (SDB), wherein said DCB stores the data for display and generates data-control-pulses for the EL segment display; and said SDB receives the data from the DCB and then drives the EL segments to display the desired information in real-time. This integrated circuit driver chip is suitable to be used to control and drive a multiple segment EL display. The applications of the IC include, but are not limited to, the display alphanumeric digits and image information. By cascading multiple IC driver chips together, it is possible to enlarge the number of display segments.

16 Claims, 10 Drawing Sheets

Fig,. 2

INTEGRATED CIRCUIT DRIVER CHIP FOR AN ELECTROLUMINESCENT DEVICE

FIELD OF THE INVENTION

The invention relates to a driver chip and more particularly to a device for driving a multiple segment electroluminescent (EL) device.

BACKGROUND OF THE INVENTION

Presently, the change of the dark-and-light status of each segment of an EL independently is controlled by a corresponding transistor, that is to say, the number of transistors increases in proportion to that of the EL. Therefore, in a multiple segment EL, a large number of transistors are required to control the dark-and-light status of the EL, which may increase the area of the circuit board for controlling the EL, and make the design of a circuit board complex and the cost higher. In addition, displaying an EL with different dark-and-light scale is generally controlled by increasing or decreasing the input voltage of a power supply circuit of the EL, or by controlling the frequency of an oscillating circuit in the power supply circuit of the EL. Accordingly, the driving circuit board should comprise the power supply circuit, which further increases the area of the circuit board. On the other hand, it is inconvenient for the user to have to be familiar with the driving method of an EL and the design procedures of a power supply circuit, in order to achieve a proper design of a driving circuit board of an EL.

SUMMARY OF THE INVENTION

Accordingly, the present invention is directed to a driver chip for a multiple segments EL that may downsize the driving circuit board, and thus make it more simple and easier to design a circuit for an EL to display information.

In order to achieve the above objects, the present invention provides an integrated circuit (IC) driver chip for a multiple segment EL device.

An EL display-data-control block (DCB) inputs display data and a display pulse into an EL and then dynamically delivering said display data according to a data locking pulse.

A display-segment-driver block (SDB) receives the display data from said DCB and then drives the EL to display information in real-time.

An EL driver chip is provided as mentioned above, wherein said driver chip further comprises a power supply control block for controlling the dark-and-light status of said EL.

An EL driver chip is provided as mentioned above, wherein said power supply control block comprises a step-up transformer, a transistor, and an oscillating circuit, said oscillating circuit outputs control signals of different frequency to the step-up transformer through said transistor, and accordingly, the step-up transformer outputs different power supplies to the EL.

An EL driver chip is provided as mentioned above, wherein said driver chip is connected to a power supply control block and said power supply control block comprises a step-up transformer and an oscillating circuit in which said oscillating circuit outputs control signals of different frequency to the step-up transformer through the-driver chip. And accordingly, the step-up transformer outputs different power supplies to the EL.

An EL driver chip is provided as mentioned above, wherein the step-up transformer is a DC-AC step-up circuit as an integrated circuit.

An EL driver chip is provided as mentioned above, wherein the electronic component parameter of said power supply control block is used to change the power supply for the EL, and therefore, to change the intensity of the EL indirectly.

An EL driver chip is provided as mentioned above, wherein said EL display-data-control block (DCB) is a shift register and said shift register comprises at least the first group of carry flip-flops and the second group of carry flip-flops. The output pins of the first group of carry flip-flops are connected with the input pins of the second group of carry flip-flops.

An EL driver chip is provided as mentioned above, wherein said display-segment-driver block (SDB) comprises a plurality of transistors connected to the output pins of said shift registers, collectors of said transistors connected to the EL.

An EL driver chip is provided as mentioned above, wherein said transistors are a plurality of NPN transistors, the base of which is connected to the output pin of said shift register through a resistor and connected in parallel to the emitter and grounded through another resistor.

An EL driver chip is provided as mentioned above, wherein said transistors are a plurality of NPN transistors, the emitter of which is connected to the output pin of said shift register and the base connected to a DC voltage through a resistor.

An EL driver chip is provided as mentioned above, wherein said transistors are a plurality of PNP transistors, the base of which is connected to the output pin of said shift register and the emitter connected to a DC voltage through a resistor.

An EL driver chip is provided as mentioned above, wherein said transistors are a plurality of PNP transistors the emitter of which is connected to the output pin of said shift register and the base grounded through a resistance and connected to a DC voltage through another resistance.

An EL driver chip is provided as mentioned above, wherein said driver chip may control the dark-and-light status of the EL by changing the display cycle time of the EL data.

The present invention further provides an EL display device comprising: a single-chip microprocessor for outputting EL display information; at least one EL driver chip, connected to said single-chip microprocessor, for receiving the EL display information and outputting the EL display driving information; a power supply circuit, connected to the EL driver chip, for supplying an EL display power supply; and at least one multiple segments EL connected to the EL driver chip and the power supply circuit, for displaying the display information with respect to said EL display driving information.

An EL display device is provided as mentioned above, wherein, said at least one driver chip is connected in cascade with each other for driving said EL.

An advantage of the present invention is to provide a novel EL driver chip, wherein the transistors for controlling the dark-and-light status of an EL is integrated into one driver chip to reduce the number of transistors required for a driving circuit and thus greatly reduces the area of the driving circuit board. The EL driver chip provided also integrates an oscillating circuit into an EL power supply control circuit which can further reduce the area of the circuit board.

At the same time, since several functions of conventional driving circuits are integrated into the driver chip and complex conventional circuits are encapsulated in one chip, it is easy for a user to design and use a powerful EL driver chip without much expertise.

The driver chip provided also integrates a multi-bit shift register inside. Said register provides a standard data transmission interface protocol to obtain a cascade-connection, to set the data content for an EL to display, and to obtain a cascade-connection which makes it easy and flexible to display the data content of the EL. In addition, when a plurality of EL driver chips are cascade-connected, these chips can be combined into one driver chip for the digital display of a multiple segments EL.

The above and other objects, features and other advantages of the present invention will be more clearly understood from the following detailed description taken in conjunction with the accompanying figures, in which:

DETAILED DESCRIPTION OF THE INVENTION

Figure 1:
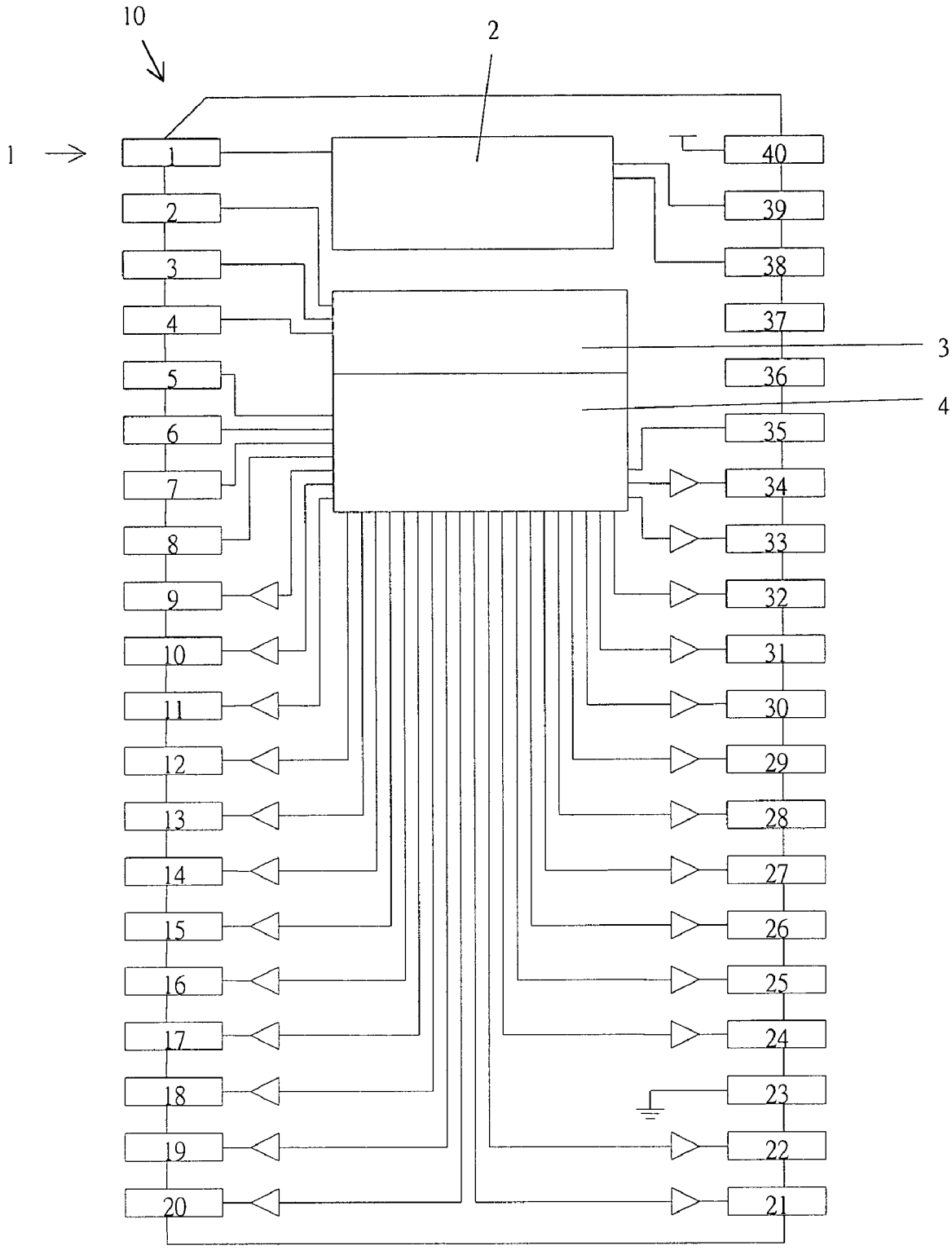
FIG. 1 is a perspective view of a driver chip according to the present invention.

As shown in FIG. 1, a driver chip according to the present invention is designed as a driver chip for a multiple segments EL with 3.5 digits. In the preferred embodiment of the driver chip, there are forty pins 1 in said driver chip which indicates different functions respectively, and reference numeral 2, 3, 4 indicates an oscillating circuit, a multi-bit shift register, and transistors respectively. The detailed function of each pin in the driver chip is described as follows:

Pin 1, P1 is connected to an external step-up transformer,

Pin 2, P2 is for the EL display data input,

Pin 3, P3 is for the EL display data input pulse,

Pin 4, P4 is for the EL display data input reset signal,

Pin 5, P5 is for the first digital data locking pulse of the EL display data, Pin 6, P6 is for the second digital data locking pulse of the EL display data, Pin 7, P7 is for the third digital data locking pulse of the EL display data, Pin 8, P8 is for the half digital data locking pulse of the EL display data, Pin 9, P9 to pin 15, P15 are for the first digital data bit of the EL display data, Pin 16, P16 to pin 22, P22 are for the second digital data bit of the EL display data, Pin 23, P23, is a grounded pin of the driver chip, Pin 24, P24 to pin 30, P30 are for the third digital data bit of the EL display data, Pin 31, P31 to pin 34, P34 are for the half digital data bit of the EL display data, Pin 35, P35 is for the cascade-connected EL display data output, Pin 36, P36 is for an external EL power supply circuit or an external power supply chip, Pin 37, P37 is a non-function pin, Pin 38, P38 to pin 39, P39 are for the frequency control of an oscillating circuit configured inside the driver chip, Pin 40, P40 is for the working power supply of the driver chip.

It is obvious from this drawing that the oscillating circuit 2, register 3, and transistors 4 are all encapsulated in one driver chip 10.

Figure 2:
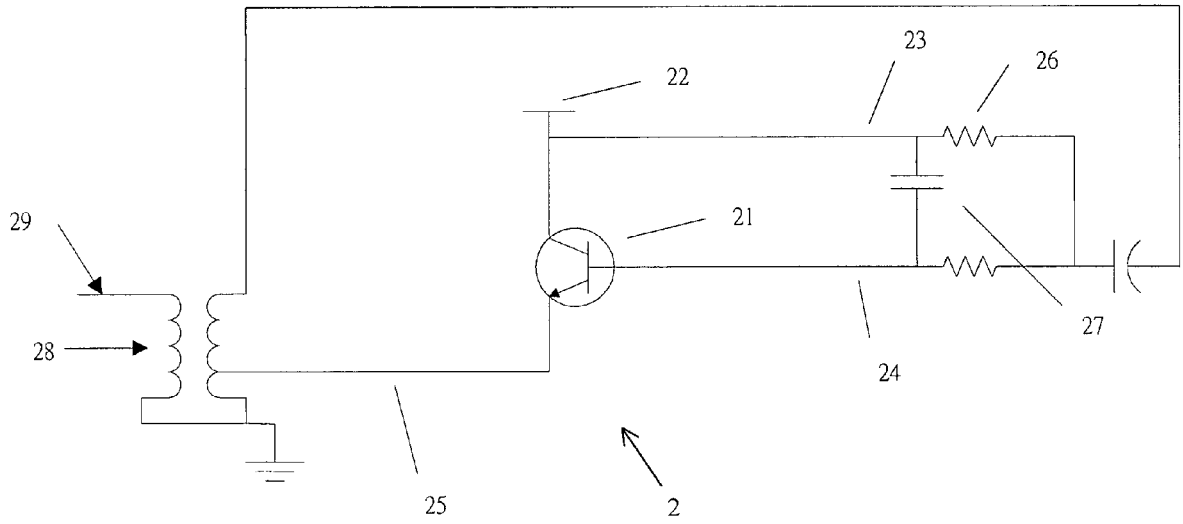
FIG. 2 is an equivalent circuit diagram of an exemplifying oscillating circuit of a driver chip.
Figure 8:
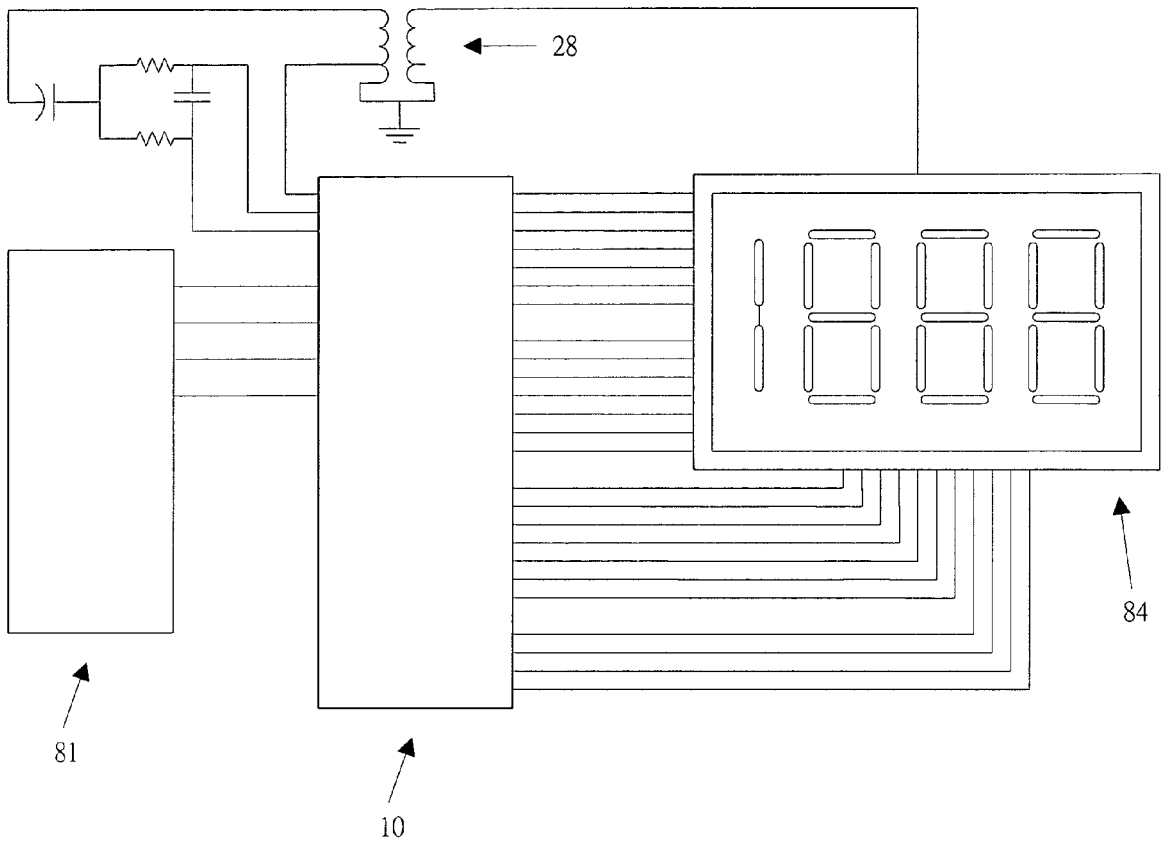
FIG. 8 shows a schematic plan view of a clock display device designed with a driver chip according to the present invention.

In the oscillating circuit 2, as shown in FIG. 2, the entire oscillating circuit 2 could be integrated in the driver chip as shown in FIG. 1, or alternatively only a transistor 21 in the oscillating circuit is integrated in the driver chip as shown in FIG. 8. The collector of transistor 21 connects to a driver chip power 22, pin P40 and to a frequency control line 23 of the driver chip oscillating circuit pin P38, the base of transistor 21 connects to another frequency control line 24 of the driver chip oscillating circuit pin P39 and the emitter of transistor 21 connects to an external step-up transformer 28 of the driver chip (pin P25). The principle of the oscillating circuit is changing the EL power supply frequency generated by the external step-up transformer pin 25 of the driver chip by adjusting the values of a resistor 26 and a capacitor 27, allowing the power output pin P29 of the external step-up transformer 28 to provide different power supplies to the EL via generating different supply frequencies input into the external step-up transformer 28; and changing the dark-and-light level of the EL with respect to the variation in the power supply of the EL.

Figure 10:
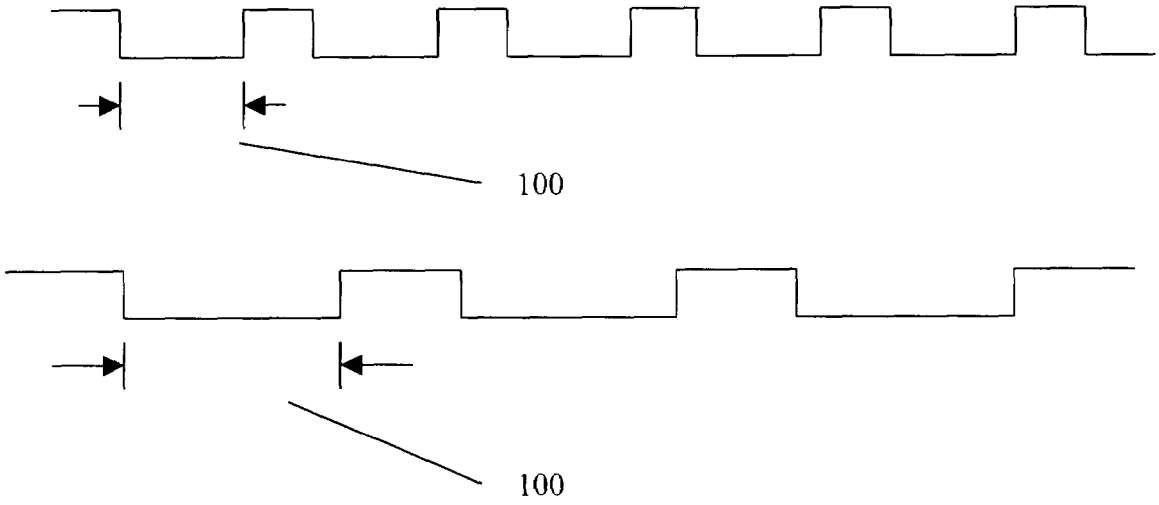
FIG. 10 shows waveforms illustrating changing the dark-and-light level of the EL according to the present invention.

In addition, another embodiment for changing the dark-and-light level of the EL is shown in FIG. 10. In the figure, controlling the locking time of the EL display data locking pulse pins (P5, P6, P7, and P8) makes changes in the dark-and-light level of the EL. When the time period of data locking pulse 100 increases, the time period of display data increases correspondingly, which results in the increase in the time period of the EL to change emitting light. On the other hand, when the time period of the data locking pulse is reduced, the time period of the EL to change light status is reduced correspondingly. Therefore, by changing the display data cycle time with the method mentioned above, dark-and-light conversion of the EL can be controlled too.

Figure 3:
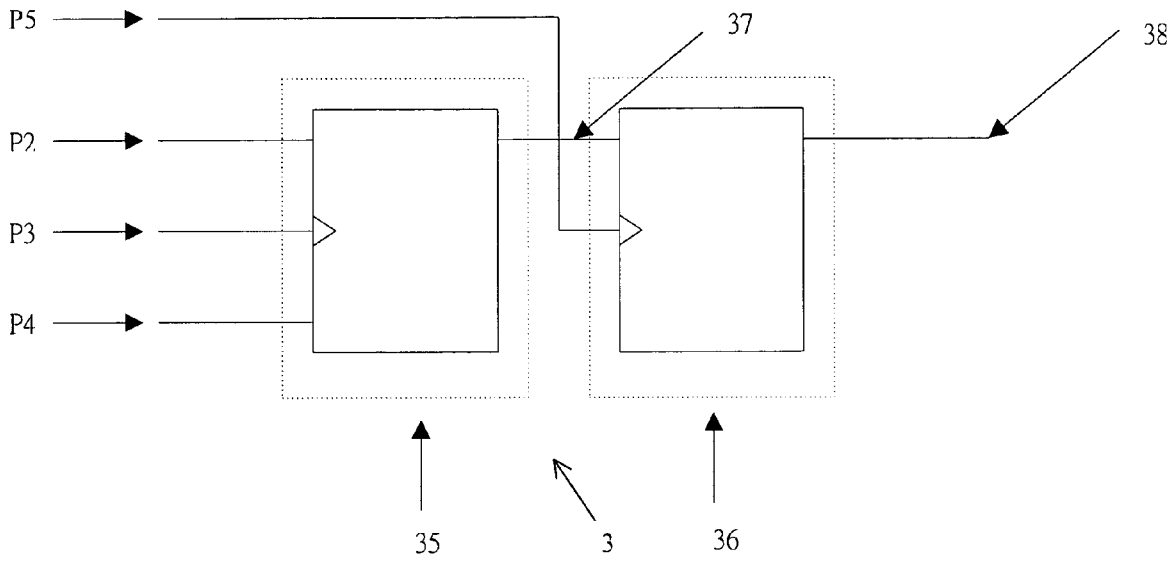
FIG. 3 is an equivalent circuit diagram of an exemplifying shift register of a driver chip.

In the multi-bit shift register 3 shown in FIG. 3, the EL display data from display data input pin P2 of the driver chip is input into the carry flip-flops 35 for the first group of 3.5 digits according to the data-in synchronizing pulse pin P3. In addition, since each data bit is input according to the synchronizing pulse, the advantage can be achieved that data is input synchronously. Since the output line of carry flip-flop 35 for the first group of 3.5 digits is connected to the input line of carry flip-flop 36 for the second group of 3.5 digits, when all the 3.5 digits of the EL display data have been input into the carry flip-flop 35 for the first group of 3.5 digits, the EL display data is sent to the input pin of carry flip-flop 37 for the second group of 3.5 digits simultaneously. When the data locking pulse is transmitted from pin P5 to the carry flip-flop 36 for the second group of 3.5 digits, the data is locked in the carry flip-flop 36 and then outputted to the bases of transistors by output pin 38 of the carry flip-flop for the second group of 3.5 digits. In addition, the data to be displayed in the EL may be changed by controlling the conductive condition of transistors.

Figure 4:
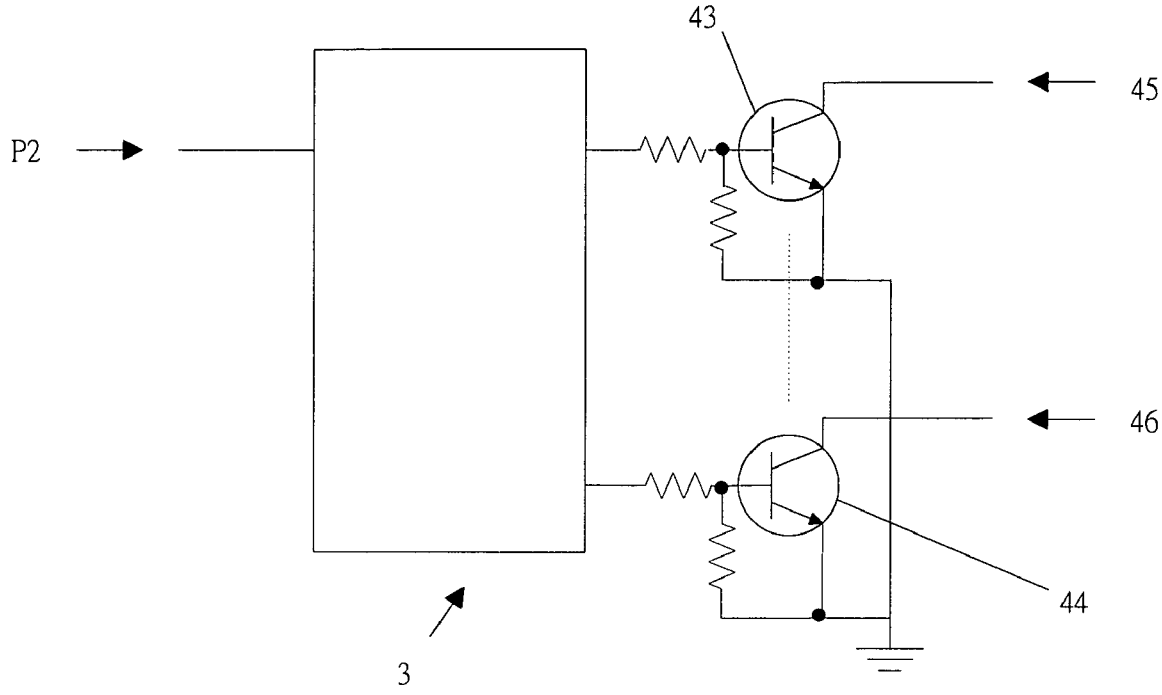
FIG. 4 is the first embodiment of the transistor structure inside a driver chip according to the present invention.

The driver chip, as shown in FIG. 4, is controlled by controlling bases of NPN transistors. When the EL data is input into multi-bit shift register 3 through data input pin P2, the data is locked in the register, and then the output data is sequentially connected to the bases of a plurality of transistors, from the NPN transistors 43 for controlling the first segment of digits to the NPN transistor 44 for controlling the last segment of the 3.5th digits. In this embodiment, there are seven segments for each digit and 3.5 digits totally, and therefore there are 24 transistors totally, as shown in FIG. 1, corresponding to 24 data output control pins P9 P15 P16–P22 P24–P30 P31–P34, respectively. The EL is connected to collectors of transistors 43 and all the emitters of transistors are connected together and grounded.

The principle for controlling the EL display by changing the conductive condition of a plurality of transistors is that, when the light emitting status of an EL is required to be changed, the data output pin which is locked in the shift register 3 inside the driver chip is set to be logical 1. And since the output pin of the shift register is connected to the bases of NPN transistors, bases of said transistors are also set to be logical 1. Additionally, the biased voltage difference between the base and the emitters of the transistors allows the electric current to flow from the output pin of the shift register 3 into the bases of the transistors to make the transistors on, and the EL circuit is grounded through the transistors. According to this principle, there is a circuit connected to the ground that makes the EL turn into the light emitting status. Contrarily, when the data locked in the inner shift register 3 of the driver chip is set to be logic zero, the bases of NPN transistors is also set to be logic zero and the bias voltage is not generated between the bases and emitters of the transistors, which makes the transistors off and the EL turn into the dark status as the circuit is cut off. As shown in FIG. 4 to reduce the bias current, there is a resistor 48 between the output of shift register 3 and each base of transistors and there is another resistor 49 between the each of the bases and each of the emitters of transistors.

Figure 5:
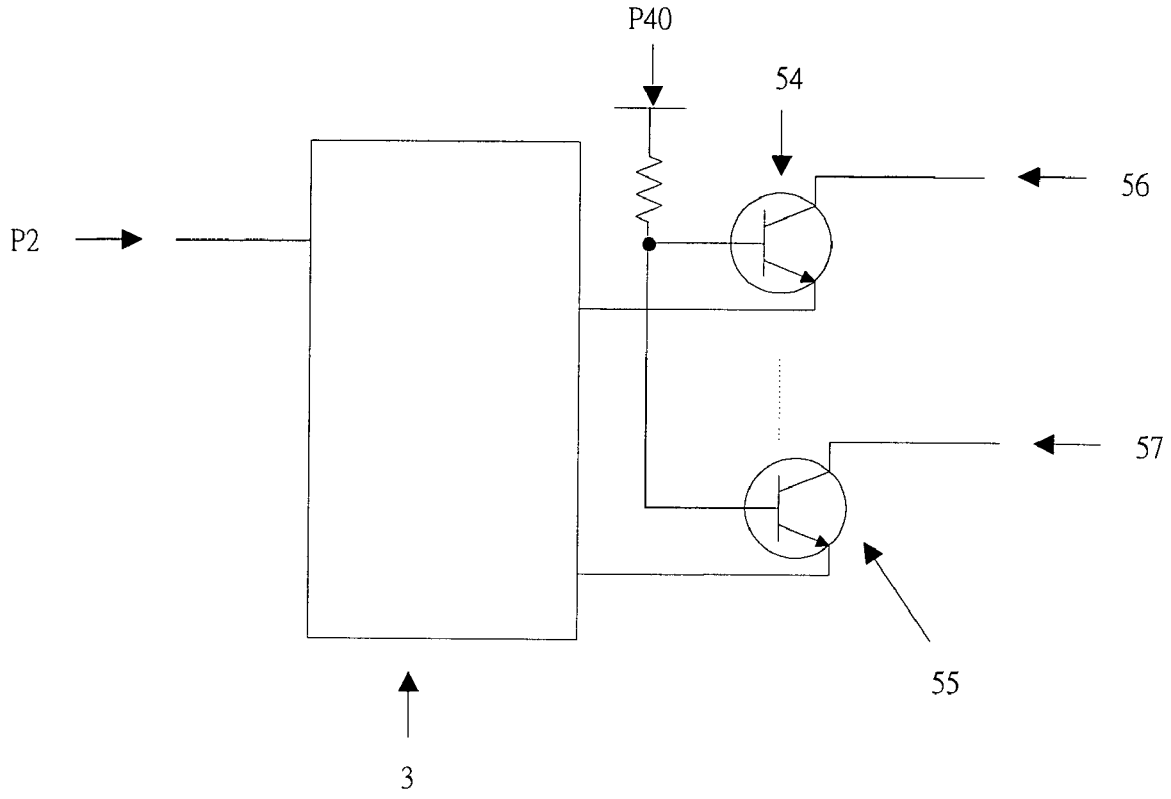
FIG. 5 is the second embodiment of the transistor structure inside a driver chip according to the present invention.

FIG. 5 shows the second embodiment to be controlled by the emitters of NPN transistors inside the driver chip according to the present invention. The operation principle is that the output pins of shift register 3 are connected to the emitters of transistors 54–55, with the bases of transistors 54–55 connected to a DC voltage, i.e., pin P40 of the driver chip, and the collectors of transistors connected to the EL. By changing the logic status of the emitters of transistor, the conductive condition of transistors 54–55 and thus the EL display data can be controlled.

Figure 6:
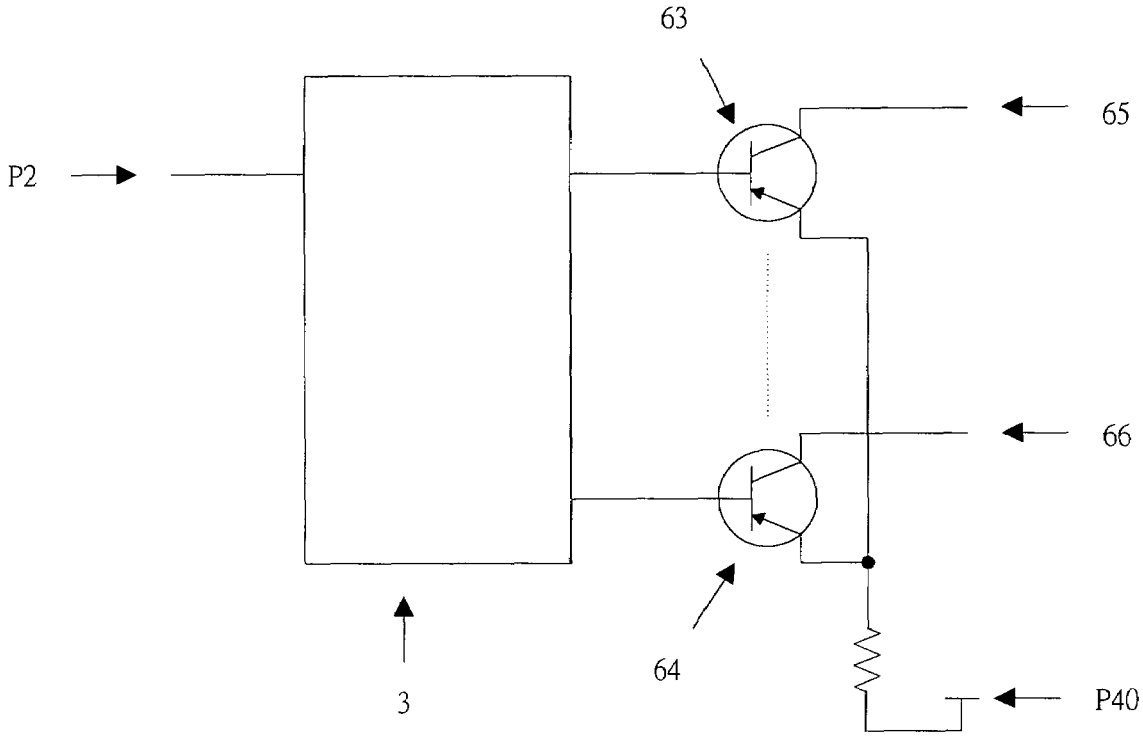
FIG. 6 is a third embodiment of the transistor structure inside a driver chip according to the present invention.

FIG. 6 shows the third embodiment to be controlled by the bases of PNP transistors inside the driver chip according to the present invention. The operation principle is that the output pins of shift register 3 are connected to the bases of transistors 63–64, with the emitters of transistors 63–64 connected to a DC voltage, i.e., pin P40 of the driver chip and the collectors of transistors connected to the EL. By changing the logic status of the bases of transistors, the conductive condition of transistors and the EL display data can both be controlled.

Figure 7:
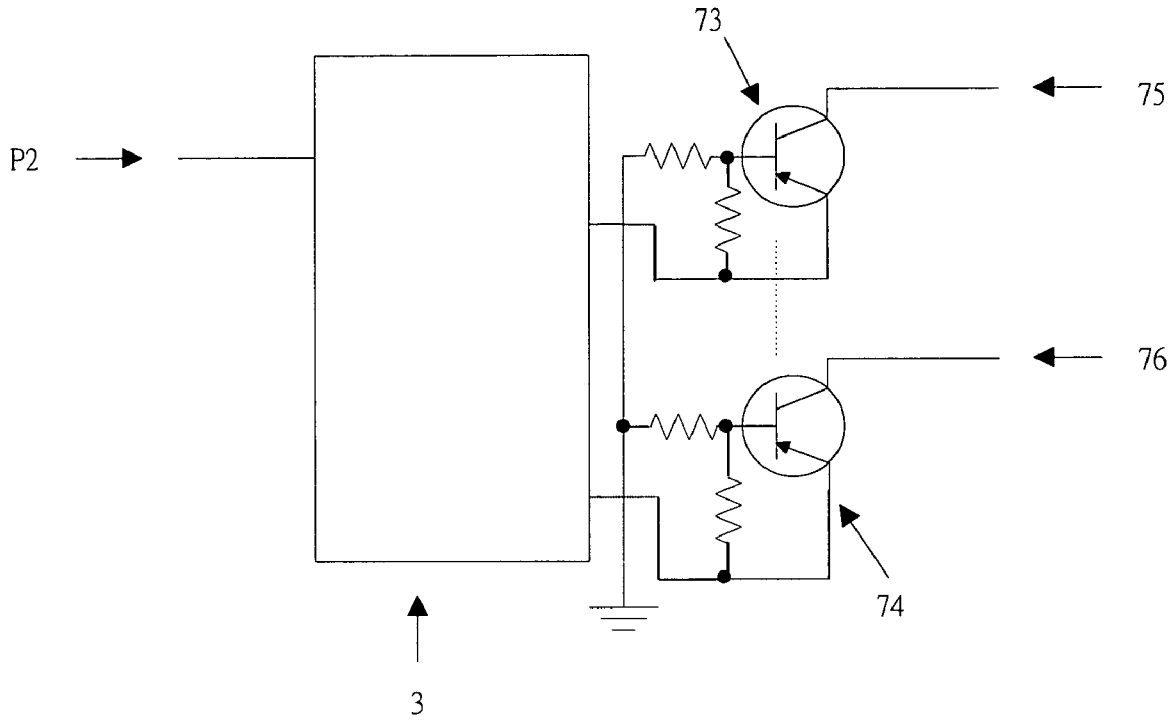
FIG. 7 is a fourth embodiment of the transistor structure inside a driver chip according to the present invention.

FIG. 7 shows the fourth embodiment to be controlled by the emitters of PNP type transistors inside the driver chip according to the present invention. The operation principle is that the output pins of shift register 3 are connected to the emitters of transistors 73–74, with the bases of transistors connected to the ground via a biasing resistor and to the output pin of shift register 3 via another resistor at the same time, and the collectors of transistors connected to the EL. By changing the logic state of the emitters of transistors, the conductive condition of transistors and the EL display data can both be controlled.

FIG. 8 shows an EL display device utilizing the driver chip 10 according to the present invention, which has a single-chip microprocessor 81. As shown in the figure, here the power supply circuit is set outside the chip in place of integrated into the chip. After setting a clock time data, a multi-bit single-chip microprocessor 81 input the data into the EL driver chip 10 and then EL driver chip 10 sends the received time data to the multiple segments EL display device 84 through 3.5 digit output pins P9, P15, P16–P22, P24–P30, P31–P34. When the multiple segments EL power supply are output to the multiple segments EL display device 84 via the power supply step-up transformer 28, the multiple segments EL display device 84 displays the clock time data set by the multi-bit single-chip microprocessor 81. By setting the multi-bit single-chip microprocessor 81 to refresh time display data automatically, the EL display device becomes a flat clock display device consequently.

Figure 9:
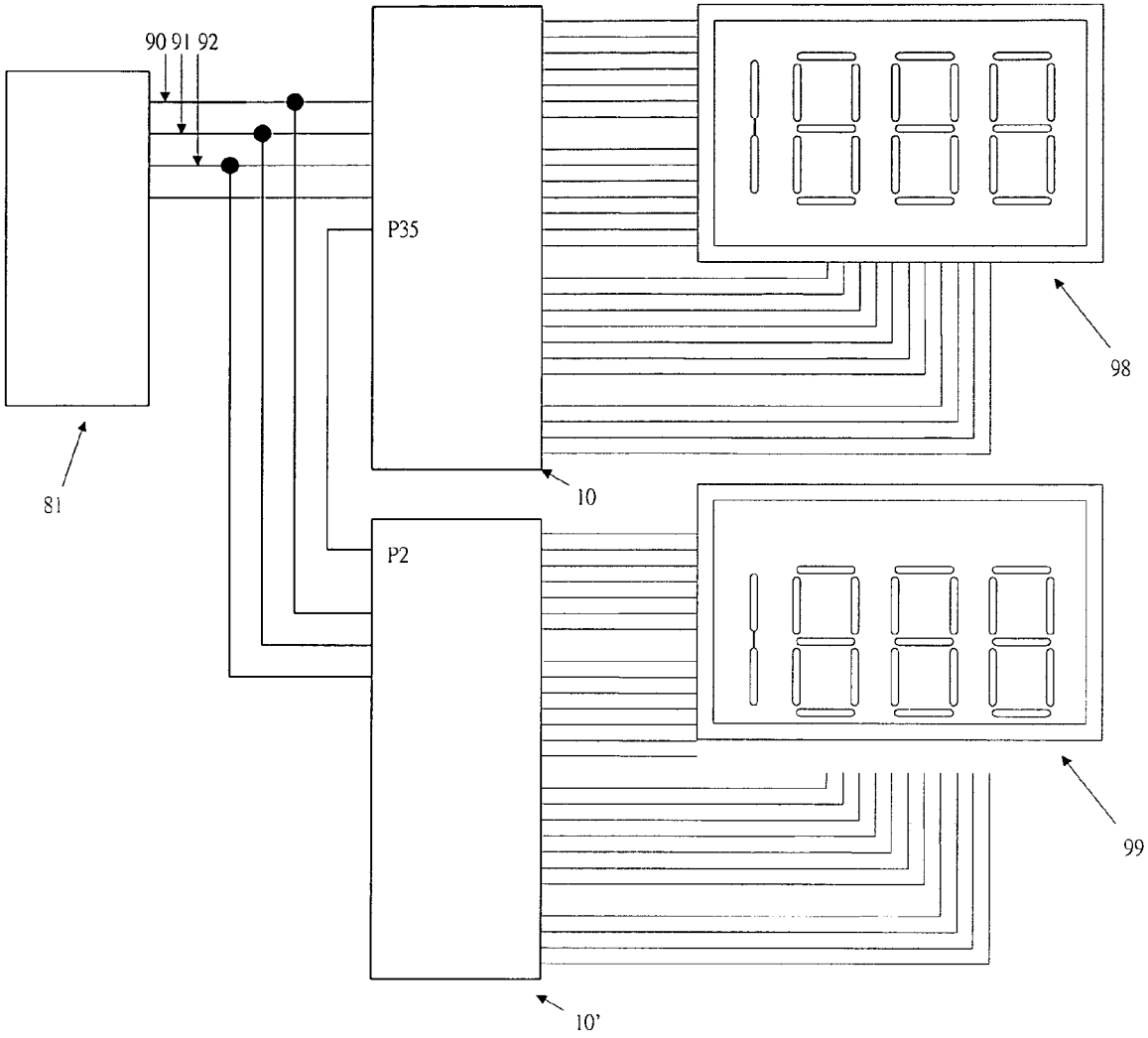
FIG. 9 shows a schematic circuit diagram of cascading multiple ELs together by the driver chip according to the present invention.

FIG. 9 shows an embodiment in which two drivers chips 10, 10' are cascade-connected. In the figure, there are a single-chip microprocessor 81, an EL display data input 90, P2, an EL display data input pulse 91, P3, an EL display data input reset signal 92, P4 and two sets of EL display device 98, 99. The principle is that information is input from P35 by the first chip 10 to the information input P2 of the next chip 10'. In addition, the EL display data input, the EL display data input pulse, and the EL display data input reset signal of these two chips are also connected together. When the display information is input into both chips through P35 and P2, the EL display data input and the display data input pulse are configured for locking the information in the chips which allows two sets of EL display device 98 and 99 to change emitting light.

Although the present invention has been described in connection with the preferred embodiments with reference to the accompanying figures, the preferred embodiments are intended not to limit the invention, and all the equivalent transformation may be made according to content of the description and accompanying figures of the present invention, such as replacing the power supply step-up transformer with other DC-AC step up circuits in an integrated circuit. We may also use either N-Channel or P-Channel field effect transistor to replace the current bipolar transistors to achieve controlling the EL segments. In both cases we may achieve the same effect, without departing from the scope and spirit of the invention.

What is claimed is:

1. An EL driver chip for multiple segments EL display comprising:

an EL display-data-control block (DCB) for inputting a display data and a display pulse into an EL, and then outputting the display data dynamically according to a data locking pulse, wherein said EL display-data-control block (DCB) is a shift register and said shift register comprises at least at least the first group of carry flip-flops and the second group of carry flip-flops, in which the output pins of said first group of carry flip-flops are connected to the input pins of the second group of carry flip-flops, and an EL driving block for receiving the EL display data from said EL display-data-control block(DCB), and driving the EL to display information in real time.

2. The EL driver chip according to claim 1 further comprising:

a power supply control block outputting a half sine truncated pulse.

3. The EL driver chip according to claim 2, wherein said power supply control block controls the dark-and-light status of said EL.

4. The EL driver chip according to claim 3, wherein said power supply control block comprises a step-up transformer, a transistor, and an oscillating circuit in which said oscillating circuit outputs control signals of different frequency to the step-up transformer through said transistor, and accordingly, the step-up transformer outputs different power supplies to the EL.

5. The EL driver chip according to claim 4, wherein said step-up transformer is a DC-AC step-up circuit as an integrated circuit.

6. The EL driver chip according to claim 4, wherein the intensity of the EL can be controlled by changing the electronic component parameter of said power supply control block.

7. The EL driver chip according to claim 2, wherein said power supply control block comprises a step-up transformer and an oscillating circuit, said oscillating circuit outputting control signals of different frequency to the step-up transformer through the driver chip, and accordingly, the step-up transformer outputs different power supplies to the EL.

8. The EL driver chip according to claim 7, wherein said step-up transformer is a DC-AC step-up circuit as an integrated circuit.

9. The EL driver chip according to claim 7, wherein the intensity of the EL can be controlled by changing the electronic component parameter of said power supply control block.

10. The EL driver chip according to claim 2, wherein said driver chip controls the dark-and-light status of said EL by changing the display cycle time of the EL data.

11. The EL driver chip according to claim 1, wherein said EL driving block comprises a plurality of transistors connected to the output pins of said shift register, collectors of these transistors are connected to the EL.

12. The EL driver chip according to claim 11, wherein said transistors are a plurality of NPN transistors, bases of which are connected to the output pins of said shift register through a resistor and bases of which are in parallel to the emitters and grounded through another resistor.

13. The EL driver chip according to claim 11, wherein said transistors are a plurality of NPN transistors, emitters of which are connected to the output pins of said shift register and bases of which are connected to a DC voltage through a resistance.

14. The EL driver chip according to claim 11, wherein said transistors are a plurality of NPN transistors, bases of which are connected to the output pins of said shift register and emitters of which are connected to a DC voltage through a resistance.

15. The EL driver chip according to claim 11, wherein said transistors are a plurality of PNP transistors, emitters of which are connected to the output pins of said shift register, bases of which are coupled with the emitters of said transistors through a resistance and grounded through another resistance.

16. An EL display device comprising:

a single-chip microprocessor for delivering EL display information, a plurality of EL driver chips connected to said single-chip microprocessor for receiving said EL display information and outputting EL display driving information, each EL driver chip including an EL display-data-control block (DCB) for inputting a display data and a display pulse into an EL, and then outputting the display data dynamically according to a data locking pulse, wherein said EL display-data-control block (DCB) is a shift register and said shift register comprises at least at least the first group of carry flip-flops and the second group of carry flip-flops, in which the output pins of said first group of carry flip-flops are connected to the input pins of the second group of carry flip-flops, a power supply circuit connected to the EL driver chip for outputting an EL display power supply, and at least one multiple segments EL connected to the EL driver chip and the power supply circuit for displaying the display information with respect to said EL display driving information;

wherein said plurality of driver chips are cascade-connected to each other for driving said EL.

* * * * *